United States Patent [19]

Weber

[11] 4,416,609

[45] Nov. 22, 1983

[54] METHOD AND APPARATUS FOR BURNING WASTE OILS

[75] Inventor: Walter Weber, Lechaschau, Austria

[73] Assignee: The Firm of Jörg Santer, Schwaz, Austria

[21] Appl. No.: 243,919

[22] PCT Filed: Jun. 27, 1980

[86] PCT No.: PCT/AT80/00020

§ 371 Date: Mar. 2, 1981

§ 102(e) Date: Mar. 2, 1981

[87] PCT Pub. No.: WO81/00144

PCT Pub. Date: Jan. 22, 1981

[30] Foreign Application Priority Data

Jun. 29, 1979 [AT] Austria ..... 4557/79

[51] Int. Cl.[3] ..... F23K 5/00

[52] U.S. Cl. ..... 431/2; 110/238; 137/14

[58] Field of Search ..... 137/14, 571; 431/2; 110/238, 346

[56] References Cited

U.S. PATENT DOCUMENTS 2,000,354 5/1935 Sherman ..... 137/14

4,008,038 2/1977 Berthiaume ..... 431/2 X

FOREIGN PATENT DOCUMENTS 2311470 10/1973 Fed. Rep. of Germany ..... 431/2

*Primary Examiner*—Edward G. Favors

*Attorney, Agent, or Firm*—Karl F. Ross; Herbert Dubno

[57] ABSTRACT

A process and an apparatus are described for burning of contaminated waste oils in pressure atomizing burners. In order to achieve a safe transport and burning of the waste oil independent from its contamination and water inclusions and the like, the waste oil is transported from a collector vessel by way of a partial vacuum into a pressure tank and is transported from the pressure tank by way of gas overpressure to the pressure atomizing nozzle, the waste oil is atomized there and burned off.

7 Claims, 2 Drawing Figures

METHOD AND APPARATUS FOR BURNING WASTE OILS

CROSS-REFERENCE TO RELATED APPLICATIONS

This application is a national phase application corresponding to the international phase application PCT/AT80/00020 filed June 27, 1980 and based upon Austrian application A 4557/79 filed June 29, 1979 under the International Convention.

FIELD OF THE INVENTION

The invention relates to a process and an apparatus for the burning of contaminated waste oils in pressure atomizer burners.

BACKGROUND OF THE INVENTION

Large amounts of contaminated waste oil are generated in industrial and manufacturing operations. These oils can contain solid materials such as metal chips as well as nonlubricating, possibly slightly corrosive chemicals and water. Such waste oils are for example generated in auto repair shops and in machine shops. The collection and disposal of such waste oils involves high costs, since for this purpose few and expensive burning facilities are available and therefor high storage and transport cost are incurred.

In order to save such disposal costs smaller shops try frequently to burn waste oil in their own oil heating units. It has been found in practice that break-down of the oil burner pump or of the pressure controller rapidly occurs. A cause for this can be the solid particles transported in the waste oil as well as the inclusion of nonlubricating media in the stream of oil.

It is not uncommon that waste oils are disposed irresponsibly in the environment in order to save high disposal costs, the result being considerable damage to the environment.

A combustion system constructed solely for waste oils is for example known from Austrian Patent AT-PS 292-900. In the system the waste oil is transported by compressed air into a separator for solid particles and is transported from the separator by partial vacuum to the burner nozzle. The burner nozzle operates in accordance with the injector principle and sucks the waste oil from the separator.

A substantial disadvantage of this proposal is that in addition to the house or shop heating system a separate burner with a boiler or the like is required. Also the conditions of the combustion are unsatisfactory. In addition waste oils with a large water content cannot be combusted, since such an amount of heat is transferred to the oil feed line that the water in the water/oil emulsion evaporates. This interrupts the feed of oil and quenches the flame.

OBJECT OF THE INVENTION

The invention has as its principal object to provide a process and an apparatus for burning to a high degree even considerably contaminated waste oils without large capital expenditure and also in an environmentally sound way.

SUMMARY OF THE INVENTION

The process according to the present invention is capable of lowering in the long run, heating costs by using the caloric values of waste oils, in spite of the additional cost of apparatus for carrying out the process of the invention.

The process for burning waste oils according to the invention comprises transferring waste oil with underpressure from a collector vessel into a pressure tank and transporting the waste oil from the pressure tank by gas pressure to the pressure atomizing nozzle, there atomizing the oil and burning it.

These steps assure that the oil supply is independent of the composition or the contamination of the oil.

In order to provide continuous combustion, it is advantageous to transport the waste oil by gas pressure from the pressure tank into an intermediate container and from the intermediate container continuously to the pressure atomizing nozzle. When the oil falls below a preset level in the pressure tank the connection between the pressure tank and the intermediate container is interrupted and waste oil is transported from the collector vessel to the pressure tank by way of gas underpressure.

In a preferred embodiment a pressure tank is connected via pipe lines to the collector vessel, to the suction side of an air pump and to a source of compressed air, and the pressure tank is connected to the pressure atomizing nozzle, the waste oil being transported by way of gas underpressure into the pressure tank and by way of gas overpressure from the waste tank to the pressure atomizing nozzle.

This system can be used without problems with a conventional heating system with a pressure atomizing oil burner.

It is furthermore advantageously provided to interpose an intermediate container between the pressure tank and the pressure atomizing nozzle, the intermediate container being connected to the source of compressed air.

For a completely automatic course of the combustion there are provided valve devices in the pipes between the collector vessel, the pressure tank, the intermediate container, the air pump and the source of compressed air, by which alternatingly on the one hand the source of compressed air can be connected to the intermediate container and the pressure tank as well as with the collector vessel and the air pump and on the other hand the pressure tank can be connected with the source of compressed air as well as with the intermediate container. Advantageously the groups of valve devices are controlled depending on the level of the waste oil in the pressure tank.

SPECIFIC DESCRIPTION

Figure 1:
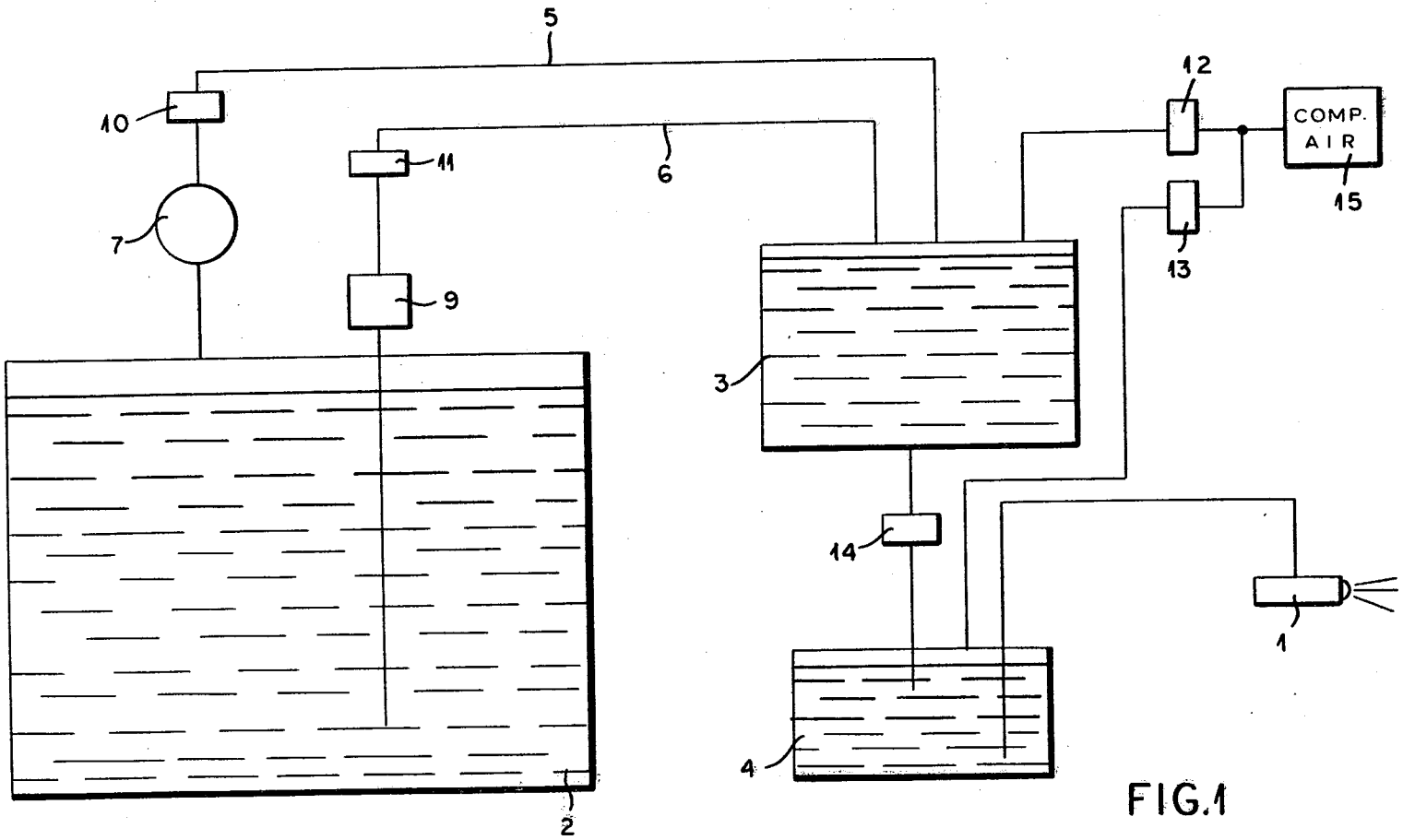
FIG. 1 is a flow diagram of the apparatus according to the present invention for performing the process.

In accordance with FIG. 1 the storage tank 2 usually employed in an oil heating system as well as the high pressure atomizing burner 1 are incorporated into the apparatus of the invention. There are provided additionally between the storage tank 2 and the burner 1 a pressure tank 3 of relatively small volume in comparison with the storage tank and an intermediate container 4 at different levels and preferably disposed one above the other. Instead of an oil supply pump there is employed in the process of the present invention compressed air from a storage container or source 15 of compressed air. The waste oil is sucked by the gas underpressure in the pressure tank 3 from the storage tank 2. The vacuum pump 7 required for this is disposed in a pipeline 5, which does not carry oil and which communicates with the pressure tank 3. An oil carrying pipe line 6 connecting the storage tank or collector vessel 2 and the pressure tank 3 comprises a filtering system 28 with a magnetic filter 9 as a means for extracting large volume, solid contaminants.

The waste oil is transferred from the pressure tank 3 to the intermediate container 4 by pressurizing the pressure tank 3 with compressed air.

The individual parts of the apparatus are connected to each other via pipelines, which can be closed by electromagnet valves 10, 11, 12, 13, 14. The electromagnet valves are actuated via various gas pressure sensors and oil float switches in a preprogrammed change, such that an automatic refilling of the pressure tank 3 and of the intermediate container 4 from the storage tank is possible and at the same time there is assured a continuous feed of oil to the atomizing burner.

Figure 2:
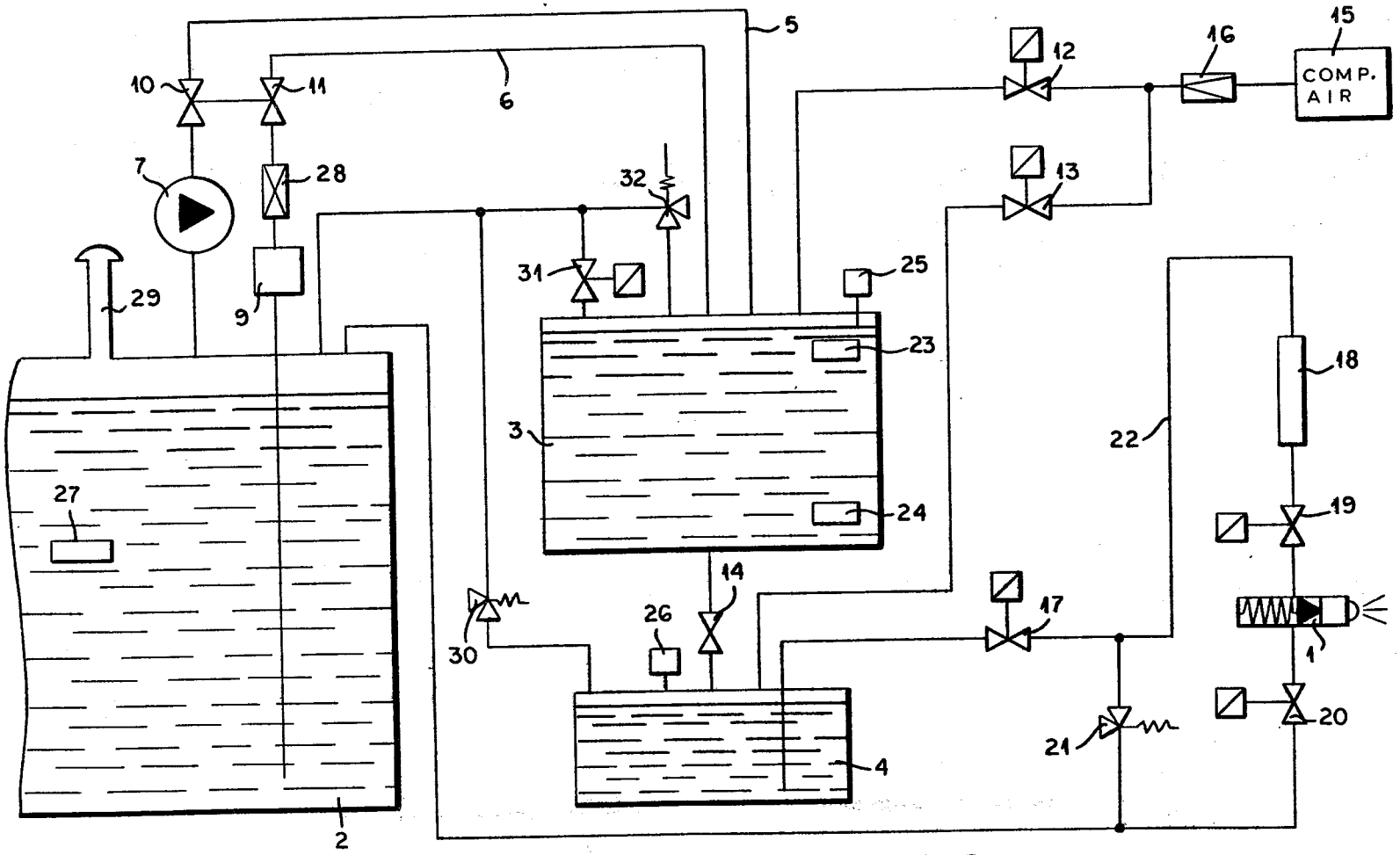
FIG. 2 is a block circuit diagram of the oil burner system, as it is advantageously employed in the practical embodiment of the process.

From FIG. 2 the functioning of the apparatus will be seen in more detail.

The intermediate container 4 is assumed to be initially partly filled with oil. The solenoid valves 12, 14 are closed and the solenoidvalve 13 is in open position such that overpressure is fed from the compressed air storage container 15 to the intermediate container 4 and thus the oil to be combusted passes through the fire-protection-solenoid valve 17 via a preheater 18 to the atomizing burner 1 past a solenoid valve 19. The solenoid valve 19 opens up only when the oil preheater 18 has reached its predetermined temperature level and thereupon the burner motor has started to run. Upon starting of the burner motor for a short time the oil is forced back through the solenoid valve 20 until the nozzle pipe is at operating temperature. Then the solenoid valve 20 closes and the oil is sprayed out of the nozzle to be burned.

As the same time as the valves 12,14 close, the valves 10,11 are opened. The vacuum pump 7 is started and generates an underpressure in pressure tank 3, such that the oil is fed from the storage tank 2 via the a system of filters 9 into the pressure tank 3.

The pressure tank 3 is filled so far until a solenoid float switch 23 responds and thereby the vacuum pump 7 is turned off and at the same time the valves 10, 11 are closed. The solenoid valve 12 is opened simultaneously with the closing of the valves 10, 11, such that now compressed air is fed to the pressure tank 3.

In order to assure that the overpressure in the pressure tank 3 has balanced with the overpressure in the intermediate container 4, the valve 14 disposed between the two opens with a delay provided by a relay. The valve 14 is preferably a motor ball valve. By way of the same relay delay the solenoid valve 13 is closed and thus the connection between the compressed air storage container 15 and the intermediate container 4 is interrupted. With these settings of the valves the oil is transported from the first into the second pressure tank (i.e. from tank 3 to tank 4). At the same time air escapes from the intermediate container 4 into the pressure tank.

If based on the heating operation the level of the oil in the pressure tank 3 falls to a minimum, then a solenoid float switch 24 responds, closes the valve 14 between the intermediate container and opens at the same time the solenoid valve 13.

Thereupon the solenoid valve 31 is opened and thereby the overpressure in the pressure tank is reduced. If this has happened then a pressure measuring apparatus 25 responds, opens the valves 10, 11 and at the same time turns on the vacuum pump 7. This represents the complete refilling cycle.

The process and the devices employed therein are fully safe against power interruptions. The electronic control is constructed such that upon power interruption all solenoid valves close with the exception of valve 20 and that they resume the position they had when the power was interrupted after the interruption is terminated.

The compressed air required for the apparatus can be provided from already installed or available compressed air apparatus in the case of shop or industrial operations. If such apparatus is not available, a small air compressor or a compressed air cylinder are required.

The additional installations for the process in accordance with the present invention do not require much space and are available at low cost when compared with the costs of a commercially sold oil heating system.

The present invention provides in particular for smaller industries and shop operations a low cost process for the disposal of generated contaminated waste oils. The expensive collecting, transporting and burning of such waste oils is eliminated. In addition, the danger is reduced that such waste oils are disposed of in a disorderly and environmentally unsafe way.

What is claimed is:

1. A method of burning waste oil comprising the steps of:

(a) collecting waste oil in a collecting vessel;

(b) applying suction to a pressure vessel and communicating said pressure vessel with said collecting vessel to draw oil from said collecting vessel through a pump-free conduit into said pressure vessel by the suction therein; and (c) thereafter forcing oil from said pressure vessel through a pump-free conduit into an atomizing burner by applying gas pressure to said pressure vessel, thereby atomizing oil in said burner under pressure and burning the atomized oil.

2. In an apparatus for burning oil which comprises a pressurized atomizing burner for atomizing the oil and combusting same, the improvement which comprises in combination with said burner:

a collecting vessel for receiving waste oil;

a pressure vessel separate from said collecting vessel;

means forming a pump-free passageway connecting said pressure vessel with said burner for transferring oil from said pressure vessel to said burner by pressurization of said pressure vessel;

a suction source connectable to said pressure vessel for generating an underpressure therein;

a pump-free conduit connecting said collecting vessel with said pressure vessel and adapted to transfer oil from said collecting vessel to said pressure vessel upon the generation of said underpressure in said pressure vessel; and a source of compressed air connectable to said pressure vessel for pressurizing oil therein to drive said oil under pressure through said transferring means to said burner.

3. In an apparatus for burning oil which comprises a pressurized atomizing burner for atomizing the oil and combusting same, the improvement which comprises in combination with said burner:

a collecting vessel for receiving waste oil;

a pressure vessel separate from said collecting vessel;

means connecting said pressure vessel with said burner for transferring oil from said pressure vessel to said burner by pressurization of said pressure vessel;

a suction source connectable to said pressure vessel for generating an underpressure therein;

a conduit connecting said collecting vessel with said pressure vessel and adapted to transfer oil from said collecting vessel to said pressure vessel upon the generation of said underpressure in said pressure vessel;

a source of compressed air connectable to said pressure vessel for pressurizing oil therein to drive said oil under pressure through said transferring means to said burner, and a duct containing a venting valve interconnecting upper portions of said vessels.

4. In an apparatus for burning oil which comprises a pressurized atomizing burner for atomizing the oil and combusting same, the improvement which comprises in combination with said burner:

a collecting vessel for receiving waste oil;

a pressure vessel separate from said collecting vessel;

means connecting said pressure vessel with said burner for transferring oil from said pressure vessel to said burner by pressurization of said pressure vessel;

a suction source connectable to said pressure vessel for generating an underpressure therein;

a conduit connecting said collecting vessel with said pressure vessel and adapted to transfer oil from said collecting vessel to said pressure vessel upon the generation of said underpressure in said pressure vessel; and a source of compressed air connectable to said pressure vessel for pressurizing oil therein to drive said oil under pressure through said transferring means to said burner, said transferring means including an intermediate vessel receiving oil from said pressure vessel and connected to deliver oil to said burner, and means connecting said intermediate vessel to said compressed air source for pressurization of said intermediate vessel independently of pressurization of said pressure vessel.

5. In an apparatus for burning oil which comprises a pressurized atomizing burner for atomizing the oil and combusting same, the improvement which comprises in combination with said burner:

a collecting vessel for receiving waste oil;

a pressure vessel separate from said collecting vessel;

means connecting said pressure vessel with said burner for transferring oil from said pressure vessel to said burner by pressurization of said pressure vessel;

a suction source connectable to said pressure vessel for generating an underpressure therein;

a conduit connecting said collecting vessel with said pressure vessel and adapted to transfer oil from said collecting vessel to said pressure vessel upon the generation of said underpressure in said pressure vessel;

a source of compressed air connectable to said pressure vessel for pressurizing oil therein to drive said oil under pressure through said transferring means to said burner; and valve means between said vessels and said sources for alternately applying said underpressure to said pressure vessel while said collecting vessel is connected thereto and said pressure vessel is cut off from said burner, and for disconnecting said pressure vessel from said collecting vessel when said pressure vessel is charged by said compressed air source.

6. The apparatus defined in claim 5 wherein said valve means includes valves automatically operated in response to the level of oil in said pressure vessel.

7. In an apparatus for burning oil which comprises a pressurized atomizing burner for atomizing the oil and combusting same, the improvement which comprises in combination with said burner:

a collecting vessel for receiving waste oil;

a pressure vessel separate from said collecting vessel;

means connecting said pressure vessel with said burner for transferring oil from said pressure vessel to said burner by pressurization of said pressure vessel;

a suction source connectable to said pressure vessel for generating an underpressure therein;

a conduit connecting said collecting vessel with said pressure vessel and adapted to transfer oil from said collecting vessel to said pressure vessel upon the generation of said underpressure in said pressure vessel;

a source of compressed air connectable to said pressure vessel for pressurizing oil therein to drive said oil under pressure through said transferring means to said burner; and a first valve in said conduit, said conduit extending below the liquid level in said collecting vessel, said suction source including another conduit connecting upper portions of said vessel and provided with an air pump, and a second valve ganged with said first valve between a suction side of said air pump and said pressure vessel, a duct interconnecting upper portions of said vessels and provided with a venting valve, said transferring means including an intermediate vessel below said pressure vessel and connected thereto by another duct provided with a third valve, said burner having a pipe reaching into said intermediate vessel and provided with a fourth valve in series with an oil preheater, said compressed air source having respective pipes with fifth and sixth valves communicating with said pressure vessel and said intermediate vessel for independently pressurizing same, and means responsive to the oil level in at least one of said vessels for controlling said valves to alternately transfer oil from said collecting vessel to said pressure vessel and from said pressure vessel to said intermediate vessel while oil from said intermediate vessel is supplied to said burner.

* * * * *